US009995498B2

(12) United States Patent
Harayama et al.

(10) Patent No.: US 9,995,498 B2
(45) Date of Patent: Jun. 12, 2018

(54) MONITORING APPARATUS AND MONITORING METHOD

(71) Applicant: AZBIL CORPORATION, Chiyoda-ku (JP)

(72) Inventors: Kazuya Harayama, Chiyoda-ku (JP); Mayumi Miura, Chiyoda-ku (JP); Masato Tanaka, Chiyoda-ku (JP)

(73) Assignee: AZBIL CORPORATION, Chiyoada-ku (JP)

( * ) Notice: Subject to any disclaimer, the term of this patent is extended or adjusted under 35 U.S.C. 154(b) by 170 days.

(21) Appl. No.: 14/978,673

(22) Filed: Dec. 22, 2015

(65) Prior Publication Data

US 2016/0187021 A1 Jun. 30, 2016

(30) Foreign Application Priority Data

Dec. 26, 2014 (JP) ..... 2014-264751

(51) Int. Cl.
*F24F 11/00* (2018.01)
*F24D 19/10* (2006.01)

(52) U.S. Cl.
CPC ..... *F24F 11/0012* (2013.01); *F24D 19/1084* (2013.01); *F24F 11/006* (2013.01);
(Continued)

(58) Field of Classification Search
USPC ..... 236/94; 165/11.1; 700/276, 278
See application file for complete search history.

(56) References Cited

U.S. PATENT DOCUMENTS 4,997,029 A * 3/1991 Otsuka ..... F24F 3/044 165/11.1
5,005,365 A * 4/1991 Lynch ..... G05D 23/1917 417/63

(Continued)

FOREIGN PATENT DOCUMENTS

JP 8-86489 A 4/1996
JP 2010-065960 A 3/2010

(Continued)

OTHER PUBLICATIONS

Kana Mizutani, et al., "Thermal Satisfaction under the Temperature Fluctuating Environment and Energy Consumption, Development of Fluctuating HVAC Control System Based on the Thermal Comfort of Office Occupants" Collection of Papers of The Society of Heating, Air-Conditioning Sanitary Engineers of Japan, pp. 2489-2492, Sep. 2012 (with English abstract).

(Continued)

*Primary Examiner* — Jianying Atkisson
*Assistant Examiner* — Paul Schwarzenberg
(74) *Attorney, Agent, or Firm* — Oblon, McClelland, Maier & Neustadt, L.L.P.

(57) ABSTRACT

A monitoring apparatus includes an information obtaining unit that obtains, from a target VAV air conditioning system to be monitored, a room temperature and a variable air volume; a room temperature display processing unit that displays, in a form of a graph, the room temperature obtained from the target VAV air conditioning system to be monitored; a controllable range calculating unit that calculates a length of a bar of a bar graph indicating a controllable range on the basis of the variable air volume; and a controllable range display processing unit that displays the bar graph including the bar having the length calculated by the (Continued)

controllable range calculating unit such that the bar graph is overlapped with the room temperature.

13 Claims, 9 Drawing Sheets

(52) U.S. Cl.
CPC ..... *F24F 11/008* (2013.01); *F24F 11/0086* (2013.01); *F24F 2011/0047* (2013.01); *F24F 2011/0061* (2013.01); *F24F 2011/0073* (2013.01); *F24F 2011/0075* (2013.01); *F24F 2011/0091* (2013.01)

(56) References Cited

U.S. PATENT DOCUMENTS 5,555,195 A * 9/1996 Jensen ..... F24F 11/0086 165/100
6,095,426 A * 8/2000 Ahmed ..... F24F 11/006 165/217
2005/0149233 A1* 7/2005 Metz ..... G05B 19/0426 700/276
2015/0094861 A1* 4/2015 Choi ..... G06F 3/04847 700/276

FOREIGN PATENT DOCUMENTS

JP 2011-145932 A 7/2011
JP 2011145932 A * 7/2011
JP 2014-009895 1/2014
JP 2014-181844 A 9/2014
JP 2014181844 A * 9/2014
JP 2014-231939 A 12/2014

OTHER PUBLICATIONS

Office Action dated Oct. 11, 2016 in Korean Patent Application No. 10-2015-0173949.
Office Action dated Jan. 31, 2018 in Japanese Patent Application No. 2014-264751 with Machine English Translation.

* cited by examiner

MONITORING APPARATUS AND MONITORING METHOD

CROSS-REFERENCE TO RELATED APPLICATIONS

This application claims priority to Japanese Application No. 2014-264751, filed Dec. 26, 2014, the entire contents of which are incorporated herein by reference.

BACKGROUND OF THE INVENTION

1. Field of the Invention

The present invention relates to a monitoring apparatus and a monitoring method for monitoring a state of a room-temperature-fluctuation air conditioning system that performs air conditioning by controlling a heating medium flow rate and a heating medium temperature and that changes a room temperature set value in accordance with a predetermined schedule or a room-temperature-fluctuation heating medium transport system that controls a heating medium flow rate and a heating medium temperature and that changes a room temperature set value in accordance with a predetermined schedule.

2. Description of the Related Art

Air conditioning control for periodically changing a room temperature set value (room temperature fluctuation control) has been developed by some research institutions and companies (see, for example, Japanese Unexamined Patent Application Publication No. 2014-009895).

Room temperature fluctuation control is regarded as control that is suitable for making energy saving and living environment quality (resident satisfaction or intellectual productivity) compatible with each other compared with ordinary room temperature constant control (see, for example, Kana MIZUTANI, Shinya NAKA, Mayumi MIURA, Chosei KASEDA, Takashi SHINOZUKA, and Toshiharu IKAGA, "Thermal Satisfaction under the Temperature Fluctuating Environment and Energy Consumption, Development of Fluctuating HVAC Control System Based on the Thermal Comfort of Office Occupants", Collection of Papers of The Society of Heating, Air-Conditioning Sanitary Engineers of Japan, pp. 2489-2492, September 2012).

Room temperature fluctuation control is control in which a room temperature set value is changed over time. Even if stable control can be temporarily performed within a controllable range, a room temperature may deviate from the controllable range as time proceeds. In the worst case, a situation may occur where the room temperature is mainly outside the controllable range and does not fluctuate at all.

During operation under the room temperature fluctuation control, it is necessary to make a prediction for the future, but there is no technique for making a prediction.

SUMMARY OF THE INVENTION

Accordingly, it is an object of the present invention to provide a monitoring apparatus and a monitoring method that enable easy prediction of whether or not room temperature fluctuation control can be performed within a controllable range.

According to an aspect of the present invention, there is provided a monitoring apparatus for monitoring a system state of a room-temperature-fluctuation air conditioning system that performs air conditioning by controlling a heating medium flow rate and a heating medium temperature and that changes a room temperature set value in accordance with a predetermined schedule or a room-temperature-fluctuation heating medium transport system that controls a heating medium flow rate and a heating medium temperature and that changes a room temperature set value in accordance with a predetermined schedule. The monitoring apparatus includes an information obtaining unit that obtains, from a target system to be monitored, a room temperature and a heating medium flow rate or an operation amount for controlling the heating medium flow rate; a room temperature display processing unit that displays, in a form of a graph, the room temperature obtained from the target system to be monitored; a controllable range calculating unit that calculates a length of a bar of a bar graph indicating a controllable range of the heating medium flow rate or a controllable range of the operation amount; and a controllable range display processing unit that displays the bar graph including the bar having the length calculated by the controllable range calculating unit such that the bar graph is overlapped with the room temperature.

In an example configuration of the monitoring apparatus, the information obtaining unit further obtains predetermined schedule information about a room temperature set value from the target system to be monitored, and the room temperature display processing unit displays, on the basis of the schedule information, estimated fluctuation of the room temperature set value for a coming certain time period.

In an example configuration of the monitoring apparatus, the controllable range calculating unit calculates the length of the bar of the bar graph on the basis of the heating medium flow rate or the operation amount obtained by the information obtaining unit, by using a conversion rate at which the heating medium flow rate or the operation amount is to be converted to a room temperature.

In an example configuration of the monitoring apparatus, the information obtaining unit further obtains a heating medium temperature from the target system to be monitored, and the controllable range calculating unit calculates the length of the bar of the bar graph on the basis of the heating medium flow rate or the operation amount obtained by the information obtaining unit, by using the conversion rate corresponding to the heating medium temperature obtained by the information obtaining unit.

An example configuration of the monitoring apparatus further includes a conversion rate calculating unit that calculates, in advance, a conversion rate on the basis of a room temperature and a heating medium flow rate or an operation amount that have previously been obtained.

In an example configuration of the monitoring apparatus, the target system to be monitored is a variable air volume air conditioning system, and the heating medium flow rate is a variable air volume and the heating medium temperature is a supply air temperature.

According to another aspect of the present invention, there is provided a monitoring method for monitoring a system state of a room-temperature-fluctuation air conditioning system that performs air conditioning by controlling a heating medium flow rate and a heating medium temperature and that changes a room temperature set value in accordance with a predetermined schedule or a room-temperature-fluctuation heating medium transport system that controls a heating medium flow rate and a heating medium temperature and that changes a room temperature set value in accordance with a predetermined schedule. The monitoring method includes an information obtaining step of obtaining, from a target system to be monitored, a room temperature and a heating medium flow rate or an operation amount for controlling the heating medium flow rate; a room temperature display processing step of displaying, in a form of a graph, the room temperature obtained from the target system to be monitored; a controllable range calculating step of calculating a length of a bar of a bar graph indicating a controllable range of the heating medium flow rate or a controllable range of the operation amount; and a controllable range display processing step of displaying the bar graph including the bar having the length calculated in the controllable range calculating step such that the bar graph is overlapped with the room temperature.

According to the present invention, chronological changes in room temperature are displayed and at the same time a bar graph indicating a controllable range is displayed such that the bar graph is overlapped with the room temperature. Accordingly, an effect can be obtained in which a janitor is capable of easily estimating whether or not room temperature fluctuation control can be performed within the controllable range.

Further, according to the present invention, estimated fluctuation of a room temperature set value is displayed, and accordingly whether or not room temperature fluctuation control can be performed within the controllable range in the future can be estimated more easily.

Further, according to the present invention, the length of a bar of a bar graph is calculated on the basis of a heating medium flow rate or an operation amount by using a conversion rate corresponding to a heating medium temperature obtained by the information obtaining unit. Accordingly, measures can be taken in a case where a heating medium temperature of the air conditioning system is changed.

DESCRIPTION OF THE PREFERRED EMBODIMENTS

Principle of Invention

The inventors focused on the point that, if feedback control such as proportional-integral-derivative (PID) control is performed on an air conditioner, a remaining power of the air conditioner for changing a room temperature is reflected in an operation amount MV calculated through control calculation. That is, a remaining power, which corresponds to a difference between a current value and an upper/lower limit value of the operation amount MV, is a factor that determines a remaining power, which is a temperature range within which the room temperature can fluctuate.

Further, the inventors have conceived that, if a controllable range of the operation amount MV is overlapped with a temperature monitoring screen (monitoring screen) in the procedure of projecting the operation amount MV at each time point on a temperature measurement value measured by a temperature sensor, the controllable range can be used as a predictive image of a range within which room temperature fluctuation control can be performed (display of remaining power for room temperature fluctuation).

First Embodiment

Figure 1:
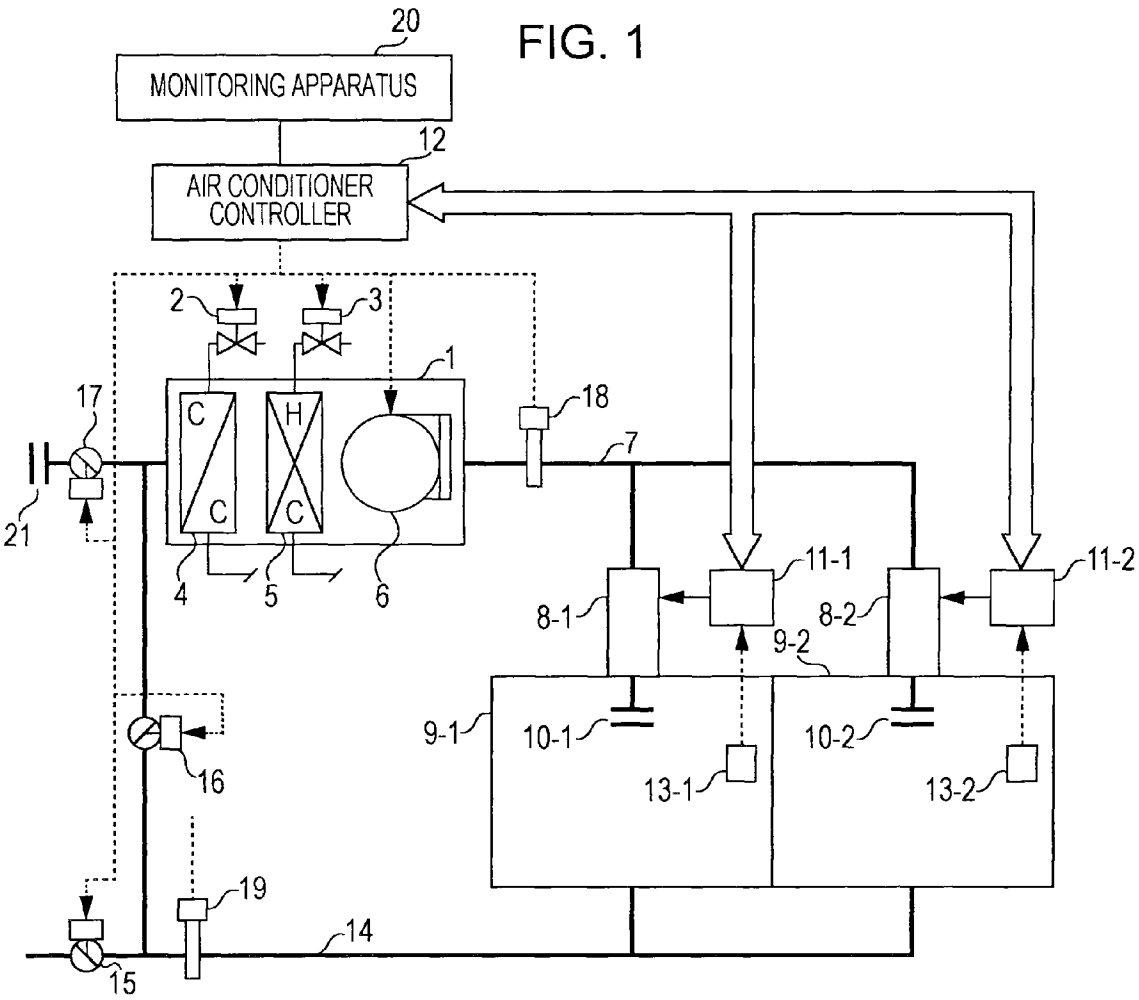
FIG. 1 is a block diagram illustrating the configuration of a VAV air conditioning system according to a first embodiment of the present invention.

Hereinafter, an embodiment of the present invention will be described with reference to the drawings. FIG. 1 is a block diagram illustrating the configuration of a variable air volume (VAV) air conditioning system according to a first embodiment of the present invention. The VAV air conditioning system according to this embodiment includes an air conditioner 1; a cold water valve 2 that controls the amount of cold water supplied to the air conditioner 1; a warm water valve 3 that controls the amount of warm water supplied to the air conditioner 1; a supply air duct 7 that supplies air from the air conditioner 1 to air conditioning zones 9-1 and 9-2, which are controlled areas; VAV units 8-1 and 8-2 that control the amounts of air to be supplied to the air conditioning zones 9-1 and 9-2, respectively; VAV controllers 11-1 and 11-2 serving as devices that control the VAV units 8-1 and 8-2, respectively; an air conditioner controller 12 that controls the air conditioner 1; temperature sensors 13-1 and 13-2 that measure room temperatures in the air conditioning zones 9-1 and 9-2, respectively; a return air duct 14; an exhaust air adjusting damper 15 that adjusts the amount of air to be exhausted to the outside; a return air adjusting damper 16 that adjusts the amount of air to be returned to the air conditioner 1; an outside air adjusting damper 17 that adjusts the amount of outside air to be taken into the air conditioner 1; a temperature sensor 18 that measures the temperature of supply air; a temperature sensor 19 that measures the temperature of return air; and a monitoring apparatus 20.

The air conditioner 1 includes a cooling coil 4, a heating coil 5, and a fan 6. The VAV units 8-1 and 8-2 and the VAV controllers 11-1 and 11-2 are provided for the air conditioning zones 9-1 and 9-2, respectively. A damper (actuator), which is not illustrated, is provided in each of the VAV units 8-1 and 8-2 so that the amount of supply air passing through each of the VAV units 8-1 and 8-2 can be adjusted. In FIG. 1, reference numerals 10-1 and 10-2 denote outlets for supply air from the air conditioner 1, and a reference numeral 21 denotes an inlet for outside air.

The rotation rate of the fan 6 in the air conditioner 1 and the degrees of opening of the cold water valve 2 and the warm water valve 3 are controlled by the air conditioner controller 12. In the case of a cooling operation, the amount of cold water supplied to the cooling coil 4 of the air conditioner 1 is controlled by the cold waver valve 2. On the other hand, in the case of a heating operation, the amount of warm water supplied to the heating coil 5 of the air conditioner 1 is controlled by the warm water valve 3.

The air that has been cooled by the cooling coil 4 or the air that has been heated by the heating coil 5 is sent by the fan 6. The air sent by the fan 6 (supply air) is supplied to the VAV units 8-1 and 8-2 for the air conditioning zones 9-1 and 9-2 via the supply air duct 7, and is supplied to the air conditioning zones 9-1 and 9-2 via the VAV units 8-1 and 8-2.

The VAV controllers 11-1 and 11-2 calculate air volumes respectively required in the air conditioning zones 9-1 and 9-2 on the basis of the difference between room temperature measurement values T measured by the temperature sensors 13-1 and 13-2 in the air conditioning zones 9-1 and 9-2 and a room temperature set value SP and transmit required air volume values to the air conditioner controller 12. Also, the VAV controllers 11-1 and 11-2 control the degrees of opening of dampers (not illustrated) in the VAV units 8-1 and 8-2 so as to obtain the required air volumes.

The air conditioner controller 12 calculates a total required air volume value of the entire system on the basis of the required air volume values transmitted from the VAV controllers 11-1 and 11-2, obtains a fan rotation rate corresponding to the total required air volume value, and controls the air conditioner 1 so that the fan 6 rotates at the obtained fan rotation rate.

The supply air that passes through the VAV units 8-1 and 8-2 and blows into the air conditioning zones 9-1 and 9-2 via the outlets 10-1 and 10-2 contributes to air conditioning control in the air conditioning zones 9-1 and 9-2 and is then exhausted via the return air duct 14 and the exhaust air adjusting damper 15. Part of the supply air is returned to the air conditioner 1 as return air via the return air adjusting damper 16. Outside air is taken in via the outside air adjusting damper 17 at a certain ratio with respect to the air returned to the air conditioner 1. The degrees of opening of the exhaust air adjusting damper 15, the return air adjusting damper 16, and the outside air adjusting damper 17 are adjusted in accordance with instructions from the air conditioner controller 12.

When the air conditioner 1 is performing a cooling operation, the air conditioner controller 12 sets the degree of opening of the warm water valve 3 to 0% and controls the degree of opening of the cold water valve 2 so that a supply air temperature measurement value Tsa measured by the temperature sensor 18 matches a supply air temperature set value SPsa. When the air conditioner 1 is performing a heating operation, the air conditioner controller 12 sets the degree of opening of the cold water valve 2 to 0% and controls the degree of opening of the warm water valve 3 so that the supply air temperature measurement value Tsa measured by the temperature sensor 18 matches the supply air temperature set value SPsa. The above-described operation is similar to that of a VAV air conditioning system according to the related art.

Further, the air conditioner controller 12 periodically changes the room temperature set value SP in accordance with a predetermined schedule, as disclosed in Japanese Unexamined Patent Application Publication No. 2014-9895 and Kana MIZUTANI, Shinya NAKA, Mayumi MIURA, Chosei KASEDA, Takashi SHINOZUKA, and Toshiharu IKAGA, "Thermal Satisfaction under the Temperature Fluctuating Environment and Energy Consumption, Development of Fluctuating HVAC Control System Based on the Thermal Comfort of Office Occupants", Collection of Papers of The Society of Heating, Air-Conditioning Sanitary Engineers of Japan, pp. 2489-2492, September 2012.

Figure 2:
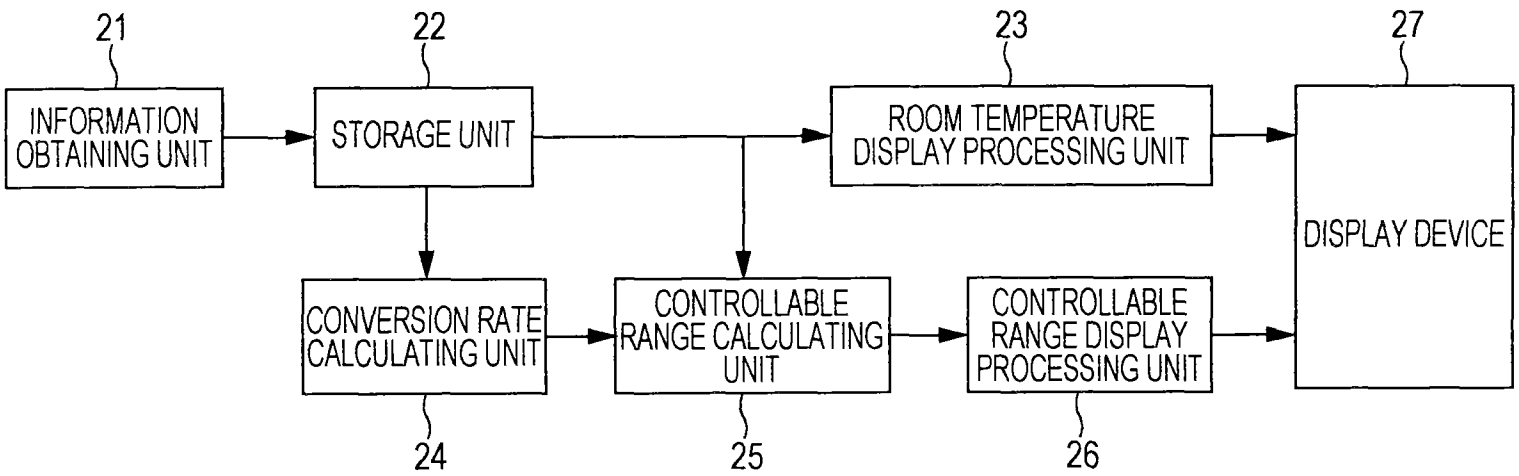
FIG. 2 is a block diagram illustrating the configuration of a monitoring apparatus of the air conditioning system according to the first embodiment of the present invention.

Next, a feature of this embodiment will be described. FIG. 2 is a block diagram illustrating the configuration of the monitoring apparatus 20 according to this embodiment. The monitoring apparatus 20 includes an information obtaining unit 21, a storage unit 22, a room temperature display processing unit 23, a conversion rate calculating unit 24, a controllable range calculating unit 25, a controllable range display processing unit 26, and a display device 27 such as a liquid crystal display.

Figure 3:
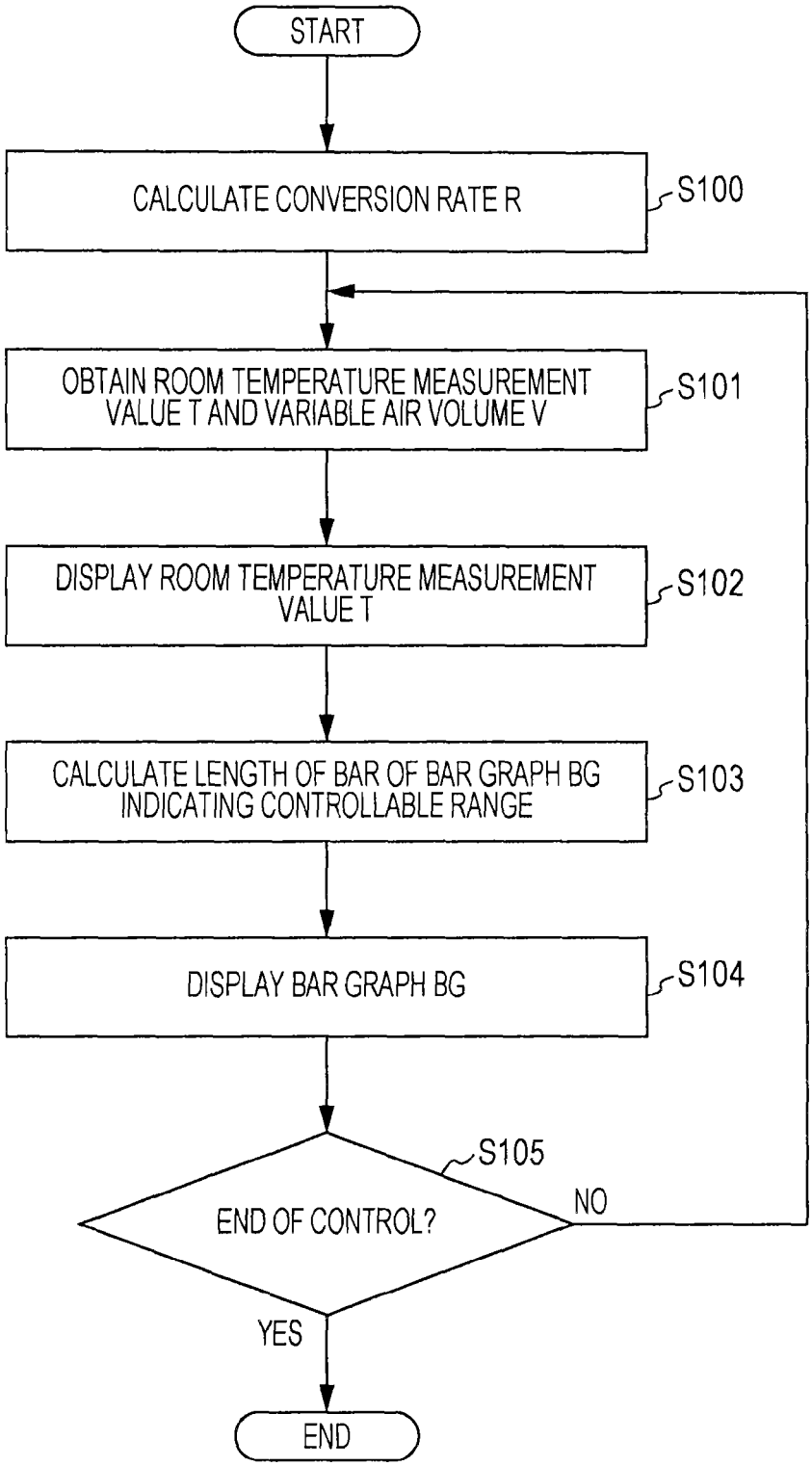
FIG. 3 is a flowchart illustrating an operation of the monitoring apparatus of the air conditioning system according to the first embodiment of the present invention.

Hereinafter, an operation of the monitoring apparatus 20 according to this embodiment will be described with reference to FIG. 3. FIG. 3 is a flowchart illustrating the operation of the monitoring apparatus 20.

The conversion rate calculating unit 24 of the monitoring apparatus 20 calculates, on the basis of data of a past room temperature measurement value T and a past variable air volume (required air volume) stored in the storage unit 22, a conversion rate R at which a variable air volume is to be converted to a room temperature (step S100 in FIG. 3). Specifically, the conversion rate calculating unit 24 calculates the conversion rate R by using the following Equation (1) on the basis of a room temperature measurement value T1 at a certain time, a variable air volume V1 calculated by the VAV controllers 11-1 and 11-2 in accordance with the room temperature measurement value T1, a room temperature measurement value T2 when the room temperature measurement value T1 is different from the room temperature set value SP, and a variable air volume V2 calculated by the VAV controllers 11-1 and 11-2 in accordance with the room temperature measurement value T2.

$$R=|\Delta T/\Delta VR|=|(T2-T1)/(VR2-VR1)| \quad (1)$$

In Equation (1), VR1 and VR2 represent an air volume ratio. An air volume ratio VRi can be calculated by using the following Equation (2) on the basis of a variable air volume Vi, a predetermined maximum air volume Vmax, and a predetermined minimum air volume Vmin.

$$VRi=(Vi-V\min)/(V\max-V\min)\times 100[\%] \quad (2)$$

Figure 4:
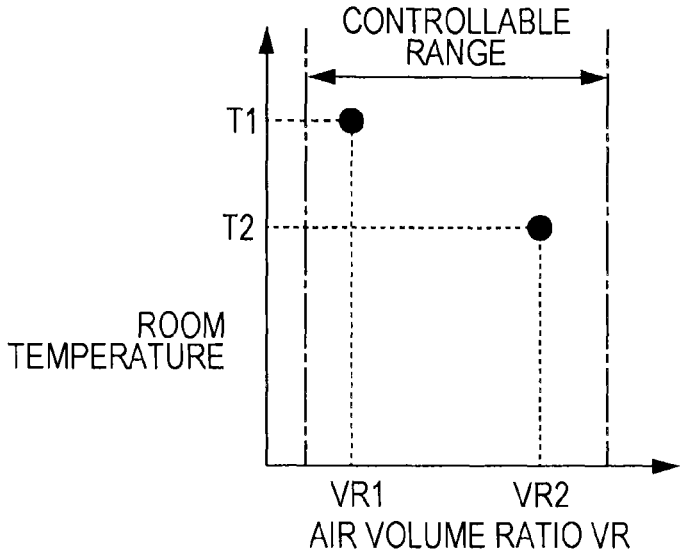
FIG. 4 is a diagram illustrating a relationship between a room temperature measurement value and an air volume ratio.

The relationship between the room temperature measurement values T1 and T2 and the air volume ratios VR1 and VR2 is illustrated in FIG. 4. FIG. 4 illustrates an example of a cooling operation. It is necessary that the air volume ratios VR1 and VR2 are within a controllable range. If the air volume ratios VR1 and VR2 become 0% or 100%, it is determined that the air volume ratios VR1 and VR2 are outside the controllable range, the data at the time is not used, and a conversion rate R is calculated by using another room temperature measurement value T and another air volume ratio VR.

The conversion rate R is changed in accordance with an air conditioning condition. In this embodiment, the conversion rate R is calculated before an air conditioning operation starts. In the case of calculating the conversion rate R before an air conditioning operation starts, past data of a room temperature measurement value T and an air volume ratio VR to be used for calculating the conversion rate R needs to be data that has been obtained under an air conditioning condition equivalent to that in the case of actually performing an air conditioning operation (inner heat generation such as heat generation of a human body or lighting, heat transmission caused by change in outside temperature, and so forth).

In this embodiment, a description has been given of a method for calculating a conversion rate R by using two sets of data each including a pair of a room temperature measurement value T and an air volume ratio VR, but three or more sets of data may be used. In this case, for example, an average value of an amount of change in a room temperature measurement value T obtained from three or more room temperature measurement values T may be used as ΔT in Equation (1), and an average value of an amount of change in an air volume ratio VR obtained from three or more air volume ratios VR may be used as ΔVR. Alternatively, the conversion rate R may be calculated in real time during an air conditioning operation.

After an air conditioning operation has started, the information obtaining unit 21 of the monitoring apparatus 20 obtains, from the air conditioner controller 12, a room temperature measurement value T and data of a variable air volume V calculated by the VAV controllers 11-1 and 11-2 in accordance with the room temperature measurement value T (step S101 in FIG. 3). The data obtained by the information obtaining unit 21 is stored in the storage unit 22.

Subsequently, the room temperature display processing unit 23 of the monitoring apparatus 20 causes the display device 27 to display, in the form of a graph, chronological changes in the room temperature measurement value T (step S102 in FIG. 3).

On the other hand, the controllable range calculating unit 25 of the monitoring apparatus 20 calculates the length of a bar of a bar graph BG indicating a controllable range (a bar graph indicating a value obtained by converting a variable width of an air volume ratio VR to a temperature variable width), the bar graph BG being displayed together with the room temperature measurement value T (step S103 in FIG. 3). To project the air volume ratio VR onto a room temperature trend graph, the air volume ratio VR [%] is converted to a room temperature [° C.]. The value obtained by converting the air volume ratio VRi [%] as a target at the current time when the length of the bar of the bar graph BG is to be calculated to a room temperature [° C.] is represented by Li, and Li can be expressed by the following Equation (3) by using the conversion rate R.

$$Li=RVRi \tag{3}$$

The air volume ratio VRi can be calculated on the basis of the variable air volume Vi at the current time as described above.

The controllable range calculating unit 25 preforms calculation of Equation (3) every display update cycle. Thus, as illustrated in FIG. 5, in the bar graph BG indicating the controllable range, a length Li corresponding to the range from 0% to the air volume ratio VRi is calculated every display update cycle.

Figure 5:
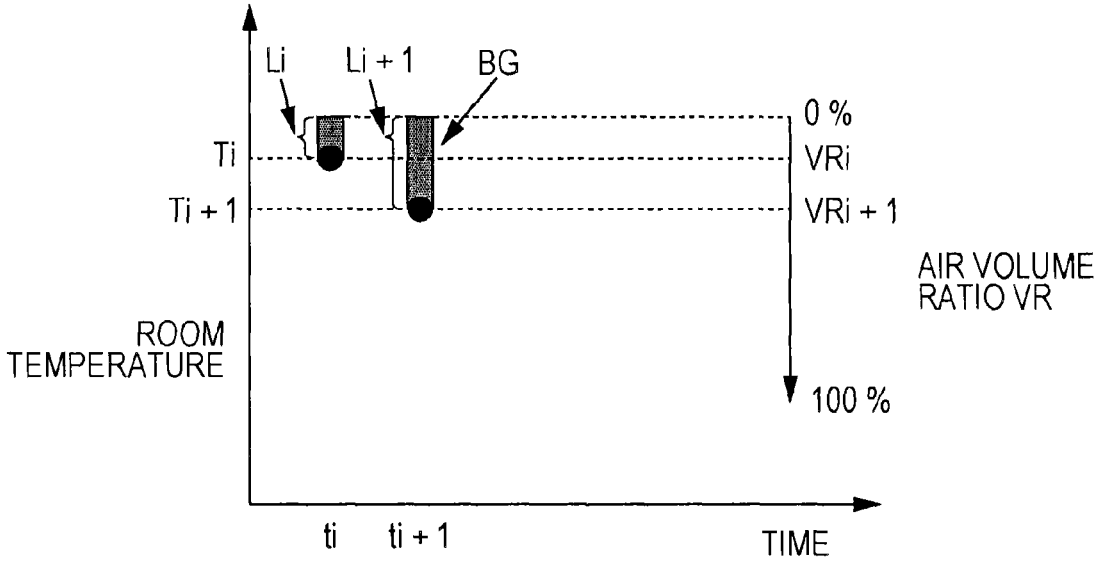
FIG. 5 is a diagram for describing a method for unit conversion of a controllable range according to the first embodiment of the present invention.

FIG. 5 illustrates an example of a cooling operation. That is, in the bar graph BG, the air volume ratio VR in the cooling operation increases in the downward direction. The top portion of the bar graph BG corresponds to the air volume ratio VR=0% in the cooling operation and the bottom portion of the bar graph BG corresponds to the air volume ratio VR=100% in the cooling operation. In contrast, in the heating operation, the air volume ratio VR increases in the upward direction. The top portion of the bar graph BG corresponds to the air volume ratio VR=100% in the heating operation and the bottom portion of the bar graph BG corresponds to the air volume ratio VR=0% in the heating operation. The point on the bar graph BG where the time ti and the room temperature measurement value Ti overlap each other corresponds to the air volume ratio VRi, which is the target for which the length of the bar of the bar graph BG is to be calculated at the time ti.

Further, the controllable range calculating unit 25 calculates, by using the following Equation (4), a length Lir corresponding to the range from the air volume ratio VRi to 100% in the bar graph BG.

$$Lir=R(100-VRi) \tag{4}$$

Figure 6:
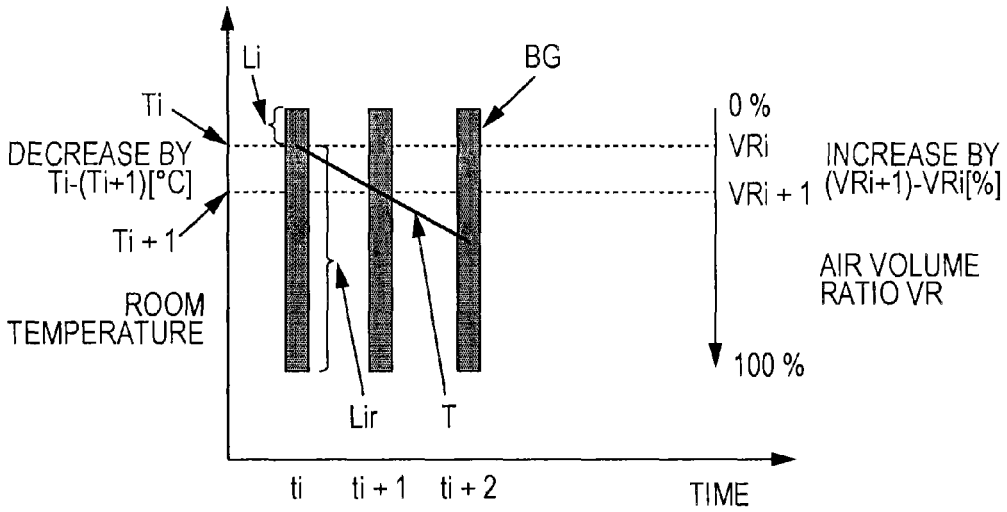
FIG. 6 is a diagram for describing a method for unit conversion of a controllable range according to the first embodiment of the present invention.

The controllable range calculating unit 25 performs calculation of Equation (4) every display update cycle. Thus, as illustrated in FIG. 6, in the bar graph BG indicating the controllable range, the length Lir corresponding to the range from the air volume ratio VRi to 100% is calculated every display update cycle. FIG. 6 illustrates, like FIG. 5, an example of a cooling operation.

Subsequently, the controllable range display processing unit 26 of the monitoring apparatus 20 causes the display device 27 to display the bar graph BG including the bar having the length calculated by the controllable range calculating unit 25 (Li+Lir) at each time such that the bar graph BG is overlapped with the room temperature measurement value Ti (step S104 in FIG. 3).

The above-described steps S101 to S104 are repeatedly performed every display update cycle until the air conditioning control is ended in response to, for example, an instruction from a building janitor (YES in step S105 in FIG. 3).

Figure 7:
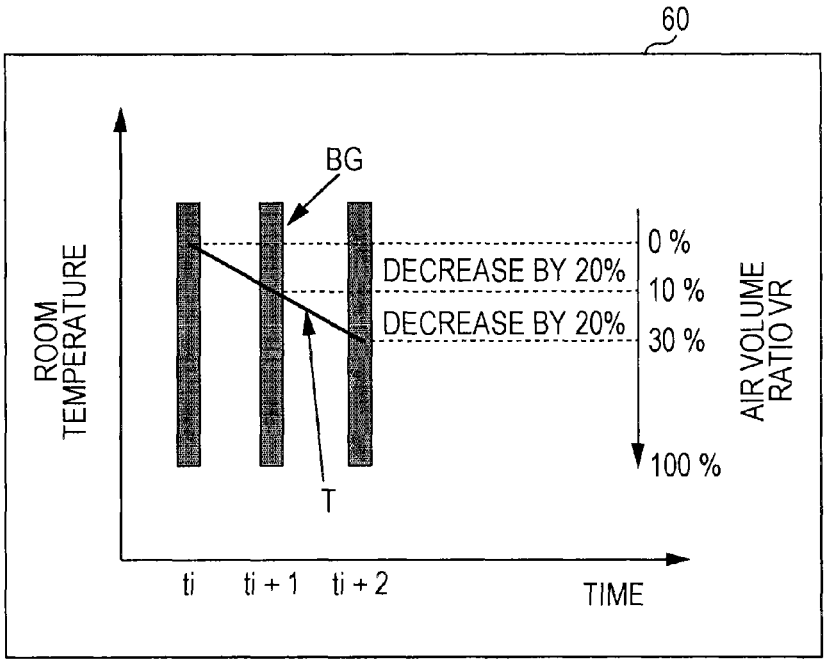
FIG. 7 is a diagram illustrating an example of a temperature monitoring screen displayed on a display device according to the first embodiment of the present invention.

FIG. 7 is a diagram illustrating an example of a temperature monitoring screen 60 (monitoring screen) displayed on the display device 27. With the repetition of the processing described above with reference to FIG. 3, the temperature monitoring screen 60 is updated, that is, the latest temperature measurement value T and the latest bar graph BG are additionally displayed every display update cycle. In the example illustrated in FIG. 7, the room temperature measurement value T is decreased by room temperature fluctuation control during a cooling operation. As described above, in the example of the cooling operation, the top portion of the bar graph BG corresponds to the air volume ratio VR=0%, the bottom portion of the bar graph BG corresponds to the air volume ratio VR=100%, the length from the point (VRi) that overlaps the room temperature measurement value Ti to the top portion of the bar graph BG is represented by Li, and the length from the point (VRi) that overlaps the room temperature measurement value Ti to the bottom portion is represented by Lir.

As described above, in this embodiment, chronological changes in the room temperature measurement value T are displayed and also the bar graph BG indicating a controllable range is displayed such that the bar graph BG is overlapped with the room temperature measurement value T. Accordingly, an effect can be obtained in which a building janitor is capable of easily estimating whether or not room temperature fluctuation control can be performed within the controllable range.

Figure 8:
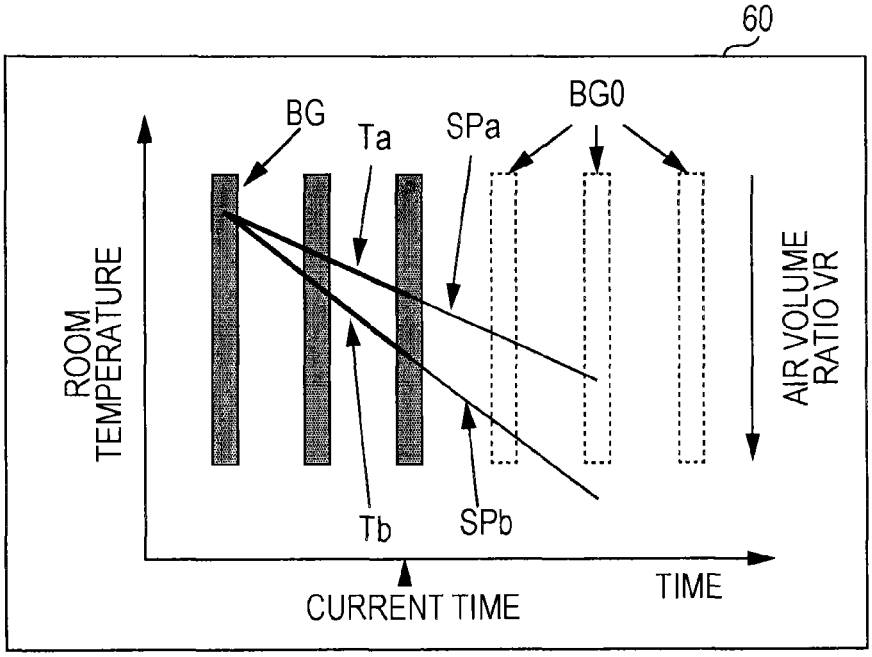
FIG. 8 is a diagram illustrating another example of a temperature monitoring screen displayed on the display device according to the first embodiment of the present invention.

Further, it is possible to make it easier to estimate whether or not room temperature fluctuation control can be performed within the controllable range in the future. Specifically, estimated fluctuation of the room temperature set value SP that the room temperature measurement value T is supposed to follow may be displayed. The temperature monitoring screen 60 in this case is illustrated in FIG. 8. To realize the display illustrated in FIG. 8, the information obtaining unit 21 obtains predetermined schedule information about the room temperature set value SP in addition to data of the room temperature measurement value T and the variable air volume V (step S101). The schedule information is stored in the storage unit 22.

The room temperature display processing unit 23 displays, at the time of displaying the room temperature measurement value T at the current time, estimated fluctuation of the room temperature set value SP for a certain time period from the current time on the basis of the schedule information (step S102). In this way, the estimated fluctuation of the room temperature set value SP that the room temperature measurement value T is supposed to follow is displayed as illustrated in FIG. 8. To comparatively describe the estimation below, FIG. 8 illustrates two cases: Spa representing the estimated fluctuation of the room temperature set value SP that the room temperature measurement value Ta is supposed to follow and SPb representing the estimated fluctuation of the room temperature set value SP that the room temperature measurement value Tb is supposed to follow.

A future controllable range (the bar graph BG0 in FIG. 8) is not displayed, but a building janitor is capable of estimating a future air conditioning state by using the bar graph BG indicating the controllable range, the room temperature measurement value T, and estimated fluctuation of the room temperature set value SP that are displayed at the current time. For example, according to the estimated fluctuation SPa of the room temperature set value SP, it can be estimated that room temperature fluctuation control can be performed within the controllable range in the future. However, in the case of the estimated fluctuation SPb of the room temperature set value SP, it is estimated that there is a possibility that the control is outside the controllable range.

Figure 9:
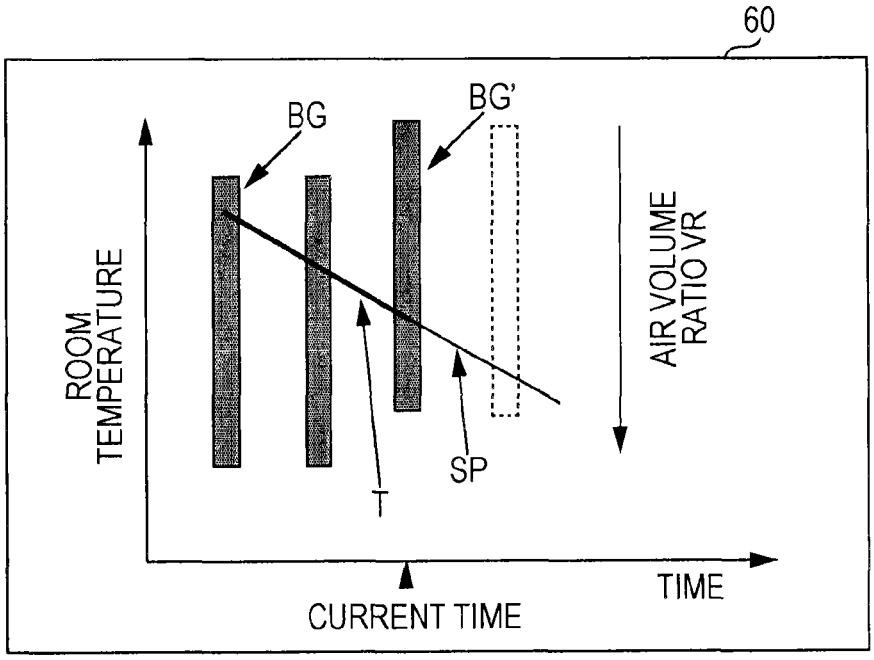
FIG. 9 is a diagram illustrating another example of a temperature monitoring screen displayed on the display device according to the first embodiment of the present invention.

The examples illustrated in FIGS. 7 and 8 show a case where an air conditioning load does not change. However, in an actual controlled area, an amount of heat processed by air conditioning is changed due to coming in and out of people or change in outside temperature. If an air conditioning load is changed, the bar graph BG indicating the controllable range shifts up or down. In the example illustrated in FIG. 9, an increase in the air conditioning load during a cooling operation causes a significant increase in the air volume ratio VRi required to cause the room temperature measurement value T to follow the room temperature set value SP, an increase in the length Li on the upper side of the bar graph BG, and a decrease in the length Lir on the lower side of the bar graph BG. As a result, the bar graph BG shifts upward as indicated by BG'.

As described above, FIGS. 5 to 9 illustrate examples of a cooling operation. In a heating operation, the top portion of the bar graph BG corresponds to the air volume ratio VR=100%, the bottom portion corresponds to the air volume ratio VR=0%, the length from the point (VRi) that overlaps the room temperature measurement value Ti to the top portion of the bar graph BG is represented by Lir, and the length from the point (VRi) that overlaps the room temperature measurement value Ti to the bottom portion is represented by Li.

Second Embodiment

Figure 10:
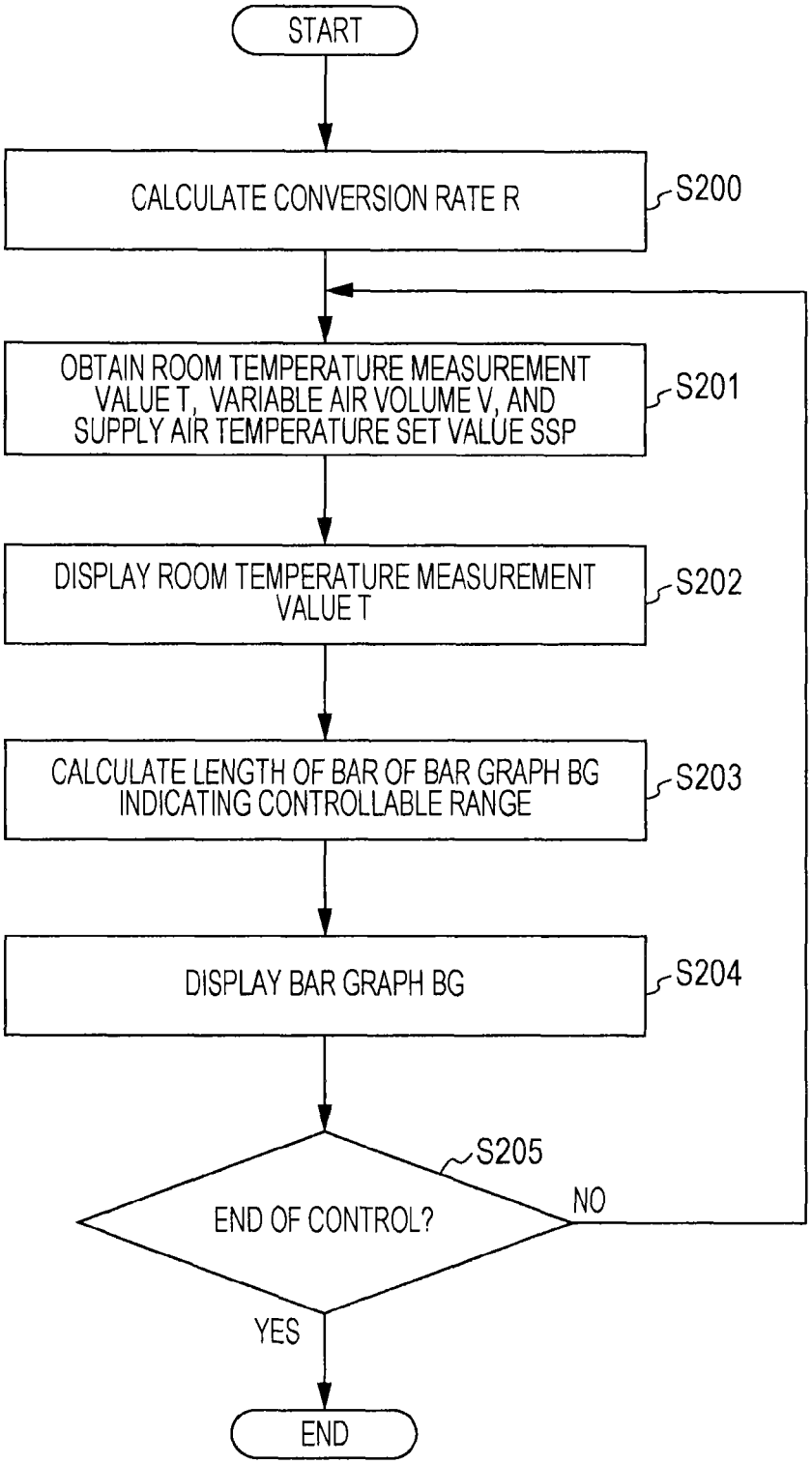
FIG. 10 is a flowchart illustrating an operation of a monitoring apparatus of an air conditioning system according to a second embodiment of the present invention.

Next, a second embodiment of the present invention will be described. In the second embodiment, the configuration of the air conditioning system is similar to that in the first embodiment, and thus the description will be given by using the reference numerals used in FIGS. 1 and 2. In this embodiment, a description will be given of an example in which a supply air temperature Tsa is changed. FIG. 10 is a flowchart illustrating an operation of the monitoring apparatus 20 according to this embodiment.

The operation of the conversion rate calculating unit 24 of the monitoring apparatus 20 (step S200 in FIG. 10) is similar to that in the first embodiment. However, in this embodiment, it is necessary to calculate and store in advance the conversion rate R for each supply air temperature Tsa. The equation for calculating the conversion rate R is the same as that described above in the first embodiment. Alternatively, conversion rates R for some representative supply air temperatures Tsa may be stored and a conversion rate R for a certain supply air temperature Tsa may be calculated by using interpolation as necessary, so as to reduce the amount of data to be stored.

After an air conditioning operation starts, the information obtaining unit 21 of the monitoring apparatus 20 obtains a room temperature measurement value T, a variable air volume V calculated by the VAV controllers 11-1 and 11-2 in accordance with the room temperature measurement value T, and data of a supply air temperature set value SPsa (or supply air temperature measurement value Tsa) from the air conditioner controller 12 (step S201 in FIG. 10). The data obtained by the information obtaining unit 21 is stored in the storage unit 22.

The operation of the room temperature display processing unit 23 of the monitoring apparatus 20 (step S202 in FIG. 10) is the same as in the first embodiment.

The controllable range calculating unit 25 of the monitoring apparatus 20 calculates the length of a bar of a bar graph BG indicating a controllable range. When performing the calculation, the controllable range calculating unit 25 performs calculation of Equations (3) and (4) by using the conversion rate R corresponding to the current supply air temperature set value SPsa (or supply air temperature measurement value Tsa) among a plurality conversion rates R stored in the conversion rate calculating unit 24 (step S203 in FIG. 10).

The operation of the controllable range display processing unit 26 of the monitoring apparatus 20 (step S204 in FIG. 10) is the same as in the first embodiment.

The above-described steps S201 to S204 are repeatedly performed every display update cycle until the air conditioning control is ended in response to, for example, an instruction from a building janitor (YES in step S205 in FIG. 10).

Figure 11:
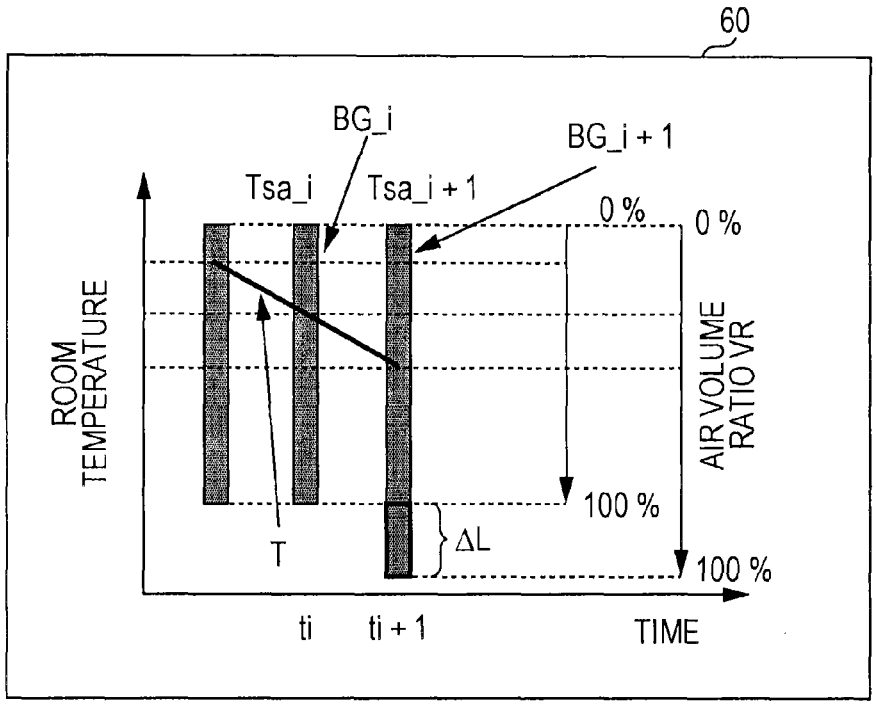
FIG. 11 is a diagram illustrating an example of a temperature monitoring screen displayed on a display device according to the second embodiment of the present invention.

FIG. 11 is a diagram illustrating an example of the temperature monitoring screen 60 displayed on the display device 27 according to this embodiment. In the example illustrated in FIG. 11, the supply air temperature measurement value Tsa decreases as a result of decreasing the supply air temperature set value SPsa in a cooling operation.

Specifically, the supply air temperature measurement value Tsa is Tsa_i at time ti, and decreases to Tsa_i+1 at time ti+1.

The decrease in the supply air temperature set value SPsa (supply air temperature measurement value Tsa) causes an increase in the conversion rate R and an increase in the controllable range. In FIG. 11, ΔL represents the increase in the controllable range.

As described above, in this embodiment, chronological changes in the room temperature measurement value T are displayed and also the bar graph BG indicating a controllable range is displayed such that the bar graph BG is overlapped with the room temperature measurement value T. Further, the length of the bar of the bar graph BG is changed in accordance with a change in the supply air temperature. Accordingly, an effect similar to that in the first embodiment can be obtained also in a case where the supply air temperature of the air conditioning system is changed.

Figure 12:
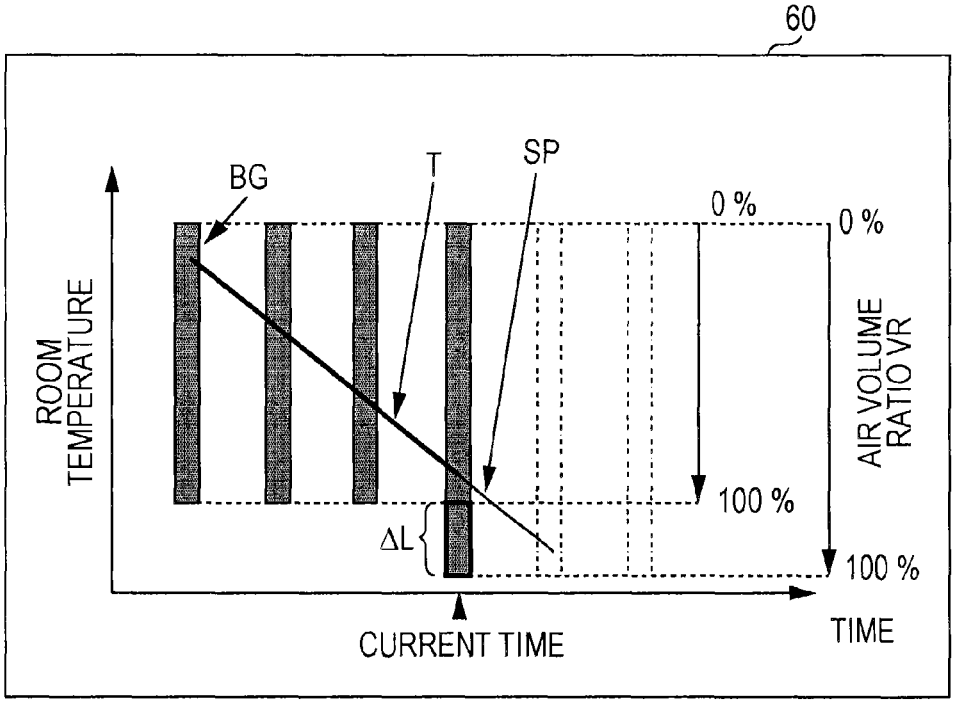
FIG. 12 is a diagram illustrating another example of a temperature monitoring screen displayed on the display device according to the second embodiment of the present invention.

As in the first embodiment, estimated fluctuation of the room temperature set value SP that the room temperature measurement value T is supposed to follow may also be displayed. The temperature monitoring screen 60 in this case is illustrated in FIG. 12. To realize the display illustrated in FIG. 12, the information obtaining unit 21 obtains predetermined schedule information about the room temperature set value SP in addition to data of the room temperature measurement value T, the variable air volume V, and the supply air temperature set value SPsa (or the supply air temperature measurement value Tsa) in step S201.

The room temperature display processing unit 23 displays, at the time of displaying the room temperature measurement value T at the current time, estimated fluctuation of the room temperature set value SP for a certain time period from the current time on the basis of schedule information (step S202). In this way, also in this embodiment, a building janitor is capable of estimating the air conditioning state in the future by using the bar graph BG indicating the controllable range, the room temperature measurement value T, and estimated fluctuation of the room temperature set value SP.

Figure 13:
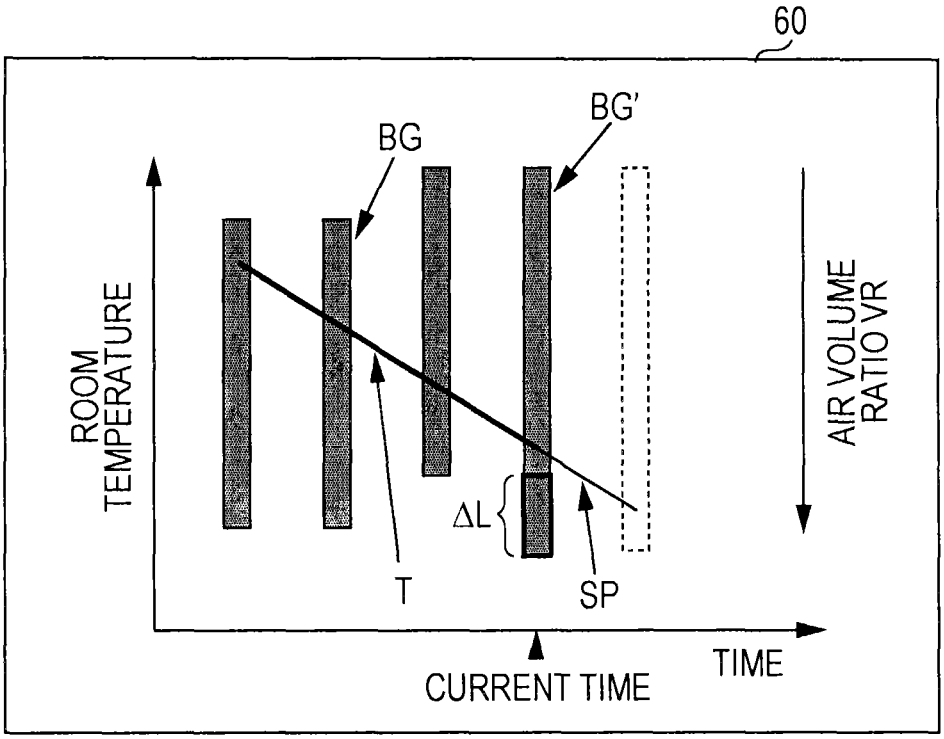
FIG. 13 is a diagram illustrating another example of a temperature monitoring screen displayed on the display device according to the second embodiment of the present invention.

The examples illustrated in FIGS. 11 and 12 show a case where an air conditioning load does not change. A case where the air conditioning load increases during a cooling operation is illustrated in FIG. 13. In the example illustrated in FIG. 13, the bar of the bar graph BG shifts upward as indicated by BG', due to an increase in the air conditioning load during a cooling operation.

As described above, FIGS. 11 to 13 illustrate an example of a cooling operation. As described above in the first embodiment, during a heating operation, the top portion of the bar graph BG corresponds to the air volume ratio VR=100%, the bottom portion corresponds to the air volume ratio VR=0%, the length from the point (VRi) that overlaps the room temperature measurement value Ti to the top portion of the bar graph BG is represented by Lir, and the length from the point (VRi) that overlaps the room temperature measurement value Ti to the bottom portion is represented by Li.

In the first and second embodiments, the controllable range is indicated by a bar graph, but the embodiments are not limited thereto. Any display method may be used as long as the controllable range can be displayed. For example, an arrow or a straight line may be used. A controllable range can be displayed also in calculation of heat budget or the like. In the first and second embodiments, the room temperature measurement value T and the variable air volume V (air volume ratio VR) have a linear relationship.

In the first and second embodiments, a description is given by using a VAV air conditioning system as an example of an application target of the present invention. The present invention is also applicable to an air-volume-changing air conditioning system that does not include a VAV unit and changes a supply air volume by using an air conditioner itself.

Further, the present invention may be applied to a multi air conditioning system for building, which is an air conditioning system using a plurality of indoor units, and a heat source water transport system (heating medium transport system) that supplies heat source water (heating medium) to an air conditioning system as illustrated in Table 1, in addition to the VAV air conditioning system and the air-volume-changing air conditioning system. In the case of any system, as in the case of the VAV air conditioning system, a system that changes the room temperature set value SP in accordance with a predetermined schedule is an application target of the present invention.

TABLE 1

| Application range | Heating medium flow rate | Heating medium temperature |
|---|---|---|
| Air-volume-changing air conditioning system | Supply air volume | Supply air temperature |
| VAV air conditioning system | Variable air volume | Supply air temperature |
| Multi air conditioning system for building | Cooling medium flow rate | Cooling medium temperature |
| Heat source water transport system | Supply water flow rate | Supply water temperature |

In a case where an application target is a VAV air conditioning system, a heating medium flow rate displayed on a temperature monitoring screen is a variable air volume (in the first and second embodiments, the air volume ratio VR), and a heating medium temperature displayed on the temperature monitoring screen is a supply air temperature.

In a case where an application target is an air-volume-changing air conditioning system, a heating medium flow rate displayed on the temperature monitoring screen is a supply air volume blown out from an air conditioner. Also in this case, an air volume ratio is actually displayed.

In a case where an application target is a multi air conditioning system for building, a heating medium flow rate displayed on the temperature monitoring screen is a flow rate of a cooling medium that flows through each indoor unit, and a heating medium temperature displayed on the temperature monitoring screen is a temperature of a cooling medium supplied to a plurality of indoor units (air conditioners). In this case, a flow rate ratio is actually displayed. When the flow rate of a cooling medium is represented by Vi, a predetermined maximum flow rate is represented by Vmax, and a predetermined minimum flow rate is represented by Vmin, a flow rate ratio VRi can be calculated by using Equation (2). The conversion rate R is changed in accordance with a cooling medium temperature, instead of a supply air temperature.

In a case where an application target is a heat source water transport system, a heating medium flow rate displayed on the temperature monitoring screen is a flow rate of heat source water, and a heating medium temperature displayed on the temperature monitoring screen is a temperature of heat source water supplied by the heat source water transport system. Also in this case, a flow rate ratio is actually displayed. The conversion rate R is changed in accordance with a temperature of heat source water, instead of a supply air temperature.

In the first and second embodiments, a description has been given of the case of a VAV air conditioning system in which data of the variable air volume V is obtained from the air conditioning system. The present invention is also applicable to an air conditioning system in which data of an operation amount MV for controlling a heating medium flow rate can be obtained instead of the variable air volume V. In the case of applying the present invention to such an air conditioning system, the air volume ratio VR in the description of the first and second embodiments may be replaced by an operation amount MV.

In a case where there are a plurality of air conditioning zones as in the first and second embodiments, display may be performed for each air conditioning zone, or display representing the individual air conditioning zones may be performed. Specifically, for example, a representative value of room temperatures in the individual air conditioning zones and a bar graph calculated on the basis of a representative value of heating medium flow rates (or operation amounts MV) in the individual air conditioning zones may be displayed.

The monitoring apparatus 20 described above in the first and second embodiments can be implemented by, for example, a computer including a central processing unit (CPU), a storage device, and an interface, and a program that controls these hardware resources. The CPU executes the processing described above in the first and second embodiments in accordance with the program stored in the storage device.

The present invention is applicable to a state monitoring technique for a room-temperature-fluctuation air conditioning system that performs air conditioning by controlling a heating medium flow rate and a heating medium temperature and that changes a room temperature set value in accordance with a predetermined schedule or a room-temperature-fluctuation heating medium transport system that controls a heating medium flow rate and a heating medium temperature and that changes a room temperature set value in accordance with a predetermined schedule.

What is claimed is:

1. A monitoring apparatus for monitoring a system state of a room-temperature-fluctuation air conditioning system that performs air conditioning by controlling a heating medium flow rate and a heating medium temperature and that changes a room temperature set value in accordance with a predetermined schedule or a room-temperature-fluctuation heating medium transport system that controls a heating medium flow rate and a heating medium temperature and that changes a room temperature set value in accordance with a predetermined schedule, the monitoring apparatus comprising:

processing circuitry configured to obtain, from a target system to be monitored, a room temperature and a heating medium flow rate or an operation amount for controlling the heating medium flow rate;

control a display to display a graph, the graph including at least a time axis and a temperature axis, the graph including the room temperature obtained from the target system to be monitored, the room temperature changing in the temperature axis along the time axis reflecting a temporal change of the room temperature;

calculate a length of a bar to be overlapped on the graph, the bar indicating a controllable range of the heating medium flow rate or a controllable range of the operation amount; and control the display to overlap the bar on the graph, the bar being provided to at least a time point in the time axis, the bar extending in the temperature axis, a first location of one edge of the bar in the temperature axis corresponding to a first temperature when the heating medium flow rate or the operation amount is 0% of the controllable range, a second location of another edge of the bar in the temperature axis corresponding to a second temperature when the heating medium flow rate or the operation amount is 100% of the controllable range.

2. The monitoring apparatus according to claim 1, wherein the circuitry is further configured to:

obtain predetermined schedule information about a room temperature set value from the target system to be monitored; and control the display to display, on the basis of the schedule information, estimated fluctuation of the room temperature set value for a coming certain time period.

3. The monitoring apparatus according to claim 1, wherein the circuitry is configured to calculate the length of the bar on the basis of the heating medium flow rate or the operation amount, by using a conversion rate at which the heating medium flow rate or the operation amount is to be converted to a room temperature.

4. The monitoring apparatus according to claim 3, wherein the circuitry is further configured to:

obtain a heating medium temperature from the target system to be monitored; and calculate the length of the bar on the basis of the heating medium flow rate or the operation amount, by using the conversion rate corresponding to the heating medium temperature.

5. The monitoring apparatus according to claim 1, wherein the circuitry is further configured to calculate, in advance, a conversion rate on the basis of a room temperature and a heating medium flow rate or an operation amount that have previously been obtained.

6. The monitoring apparatus according to claim 1, wherein the target system to be monitored is a variable air volume air conditioning system, and the heating medium flow rate is a variable air volume and the heating medium temperature is a supply air temperature.

7. A monitoring method for monitoring a system state of a room-temperature-fluctuation air conditioning system that performs air conditioning by controlling a heating medium flow rate and a heating medium temperature and that changes a room temperature set value in accordance with a predetermined schedule or a room-temperature-fluctuation heating medium transport system that controls a heating medium flow rate and a heating medium temperature and that changes a room temperature set value in accordance with a predetermined schedule, the monitoring method comprising:

obtaining, from a target system to be monitor a room temperature and a heating medium flow rate or an operation amount for controlling the heating medium flow rate;

controlling a display to display a graph, the graph including at least a time axis and a temperature axis, the graph including the room temperature obtained from the target system to be monitored, the room temperature changing in the temperature axis along the time axis reflecting a temporal change of the room temperature;

calculating, using processing circuitry, a length of a bar to be overlapped on the graph, the bar indicating a controllable range of the heating medium flow rate or a controllable range of the operation amount; and controlling the display to overlap the bar on the graph, the bar being provided to at least a time point in the time axis, the bar extending in the temperature axis, a first location of one edge of the bar in the temperature axis corresponding to a first temperature when the heating medium flow rate or the operation amount is 0% of the controllable range, a second location of another edge of the bar in the temperature axis corresponding to a second temperature when the heating medium flow rate or the operation amount is 100% of the controllable range.

8. The monitoring method according to claim 7, further comprising:

obtaining predetermined schedule information about a room temperature set value from the target system to be monitored; and controlling the display to display, on the basis of the schedule information, estimated fluctuation of the room temperature set value for a coming certain time period.

9. The monitoring method according to claim 7, wherein the calculating includes calculating the length of the bar on the basis of the heating medium flow rate or the operation amount, by using a conversion rate at which the heating medium flow rate or the operation amount is to be converted to a room temperature.

10. The monitoring method according to claim 9, further comprising:

obtaining a heating medium temperature from the target system to be monitored; and calculating the length of the bar on the basis of the heating medium flow rate or the operation amount, by using the conversion rate corresponding to the heating medium temperature.

11. The monitoring method according to claim 7, further comprising:

calculating, in advance, a conversion rate on the basis of a room temperature and a heating medium flow rate or an operation amount that have previously been obtained.

12. The monitoring method according to claim 7, wherein the target system to be monitored is a variable air volume air conditioning system, and the heating medium flow rate is a variable air volume and the heating medium temperature is a supply air temperature.

13. The monitoring apparatus according to claim 1, wherein the first and second temperatures change as an air conditioning load of the room-temperature-fluctuation air conditioning system changes.

* * * * *